United States Patent [19]

Cronan

[11] 4,436,208

[45] Mar. 13, 1984

[54] GUIDE MEMBER FOR A ROLLER-TYPE CLASSIFYING MACHINE

[76] Inventor: Walter I. Cronan, 125 Lakeview Ave., Leonia, N.J. 07605

[21] Appl. No.: 336,633

[22] Filed: Jan. 4, 1982

[51] Int. Cl.[3] ..... B07C 5/04

[52] U.S. Cl. ..... 209/668; 209/670; 209/673

[58] Field of Search ..... 209/621, 659, 660, 662, 209/667, 668, 670, 673, 933; 198/624, 722, 786

[56] References Cited

U.S. PATENT DOCUMENTS

| | | | |
|---|---|---|---|
| 788,618 | 5/1905 | Widney | 209/662 |
| 2,425,478 | 8/1947 | Lawton et al. | 209/668 |
| 2,661,090 | 12/1953 | Garrett | 209/668 |
| 3,260,364 | 7/1966 | England | 209/668 |
| 3,661,257 | 5/1972 | Hall et al. | 209/662 |
| 3,874,508 | 4/1975 | Cronan | 209/668 |

FOREIGN PATENT DOCUMENTS

| | | | |
|---|---|---|---|
| 341269 | 9/1921 | Fed. Rep. of Germany | 209/670 |
| 164097 | 9/1933 | Switzerland | 209/670 |

*Primary Examiner*—Robert B. Reeves
*Assistant Examiner*—Edward M. Wacyra
*Attorney, Agent, or Firm*—Darby & Darby

[57] ABSTRACT

A guide member is provided along the length of and between the two rollers of a classifying machine. The guide member is positioned in proximity to one of the rollers and the height of the guide member is fixed according to the shape and size of a workpiece so that the guide member supports one end of the workpiece when that end of the workpiece is in contact with the surface of the roller adjacent the guide member. When a workpiece is fed onto the rollers, one end of it is guided onto the guide member and buttressed against the surface of the adjacent roller. The other end of the workpiece is guided onto the surface of the other roller so that the workpiece is supported by the two rollers and the guide member in a stable configuration.

24 Claims, 18 Drawing Figures

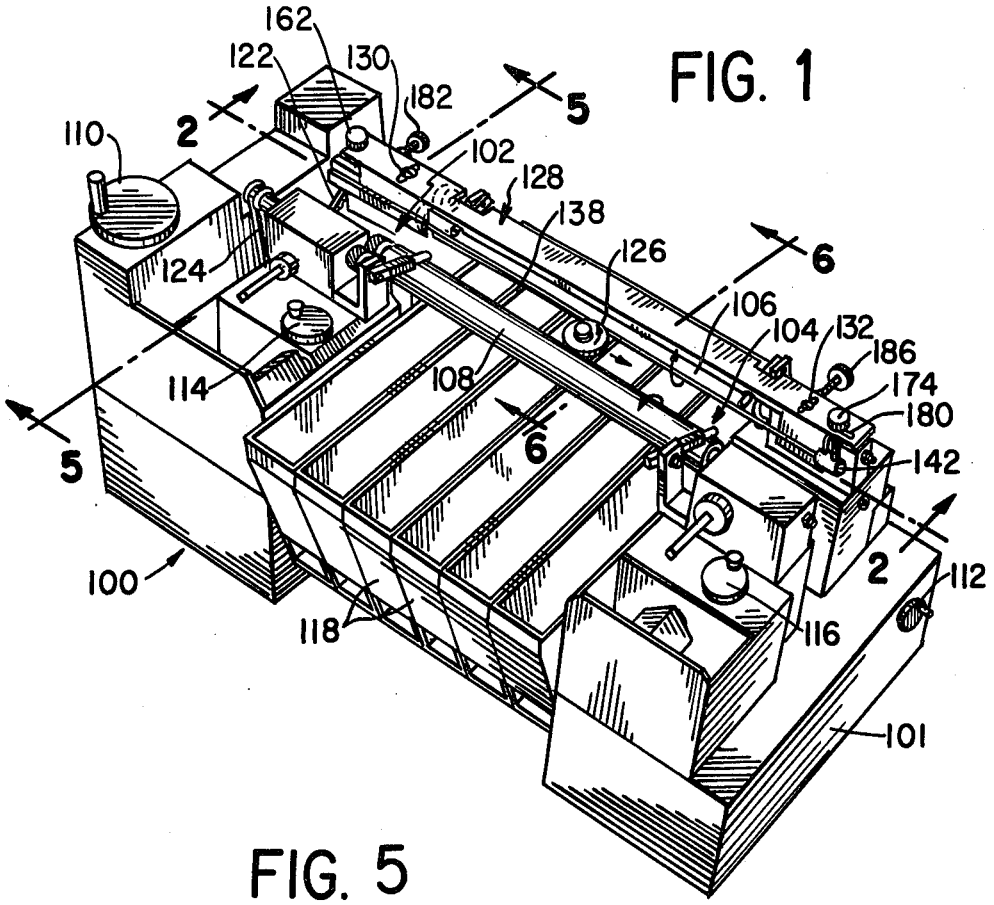
FIG. 1
FIG. 5
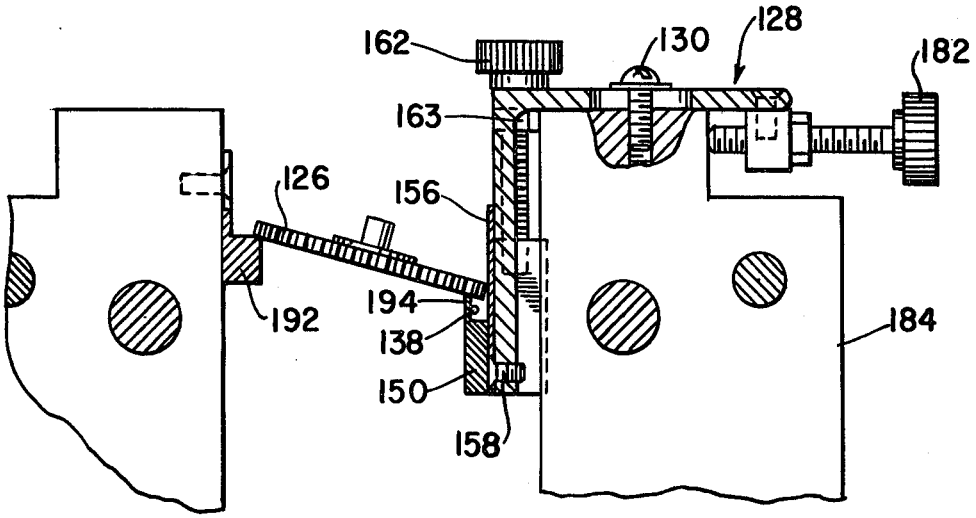

GUIDE MEMBER FOR A ROLLER-TYPE CLASSIFYING MACHINE

BACKGROUND AND SUMMARY

This invention relates generally to the field of classifying machines, and more specifically to guides for supporting articles travelling along the rollers of such machines.

Classifying machines, as defined herein, are machines which use precision made, rotating rollers for the classification, measurement or inspection of articles. The rollers are aligned with their axes in the same plane and with their rolling surfaces facing and spaced apart from each other. They may be oriented in either a parallel or slightly oblique relationship, depending on the task which the machine was designed to perform.

An example of such an apparatus may be found in U.S. Pat. No. 3,874,508 for a CLASSIFYING MACHINE, issued on Apr. 1, 1975, which is incorporated herein by reference. That apparatus contains one roller in fixed relation to a supporting framework, and a second roller, facing the first, which is adjustable relative to it so as to create a gap of desired dimension between the rollers. The rollers are inclined and rotated about their axes during use, so that an article, or workpiece, placed between the rollers at their upper end will be fed along the rollers toward their lower end by a combination of gravity and roller rotation. While the invention is discussed in conjunction with this specific classifying machine, any classifying machine may advantageously employ one or more of the inventive improvements disclosed.

When used for classifying workpieces, the rollers of the above-described classifying machine are usually arranged in an oblique, or "V"-shaped configuration, so that a given workpiece will eventually reach a clearing point and drop between the rollers into a classifying chute or hopper. The machine may also be operated as a travelling "V block" for measuring or otherwise inspecting workpieces whose shapes permit stable seating between the rollers. In this case, the rollers are adjusted to be parallel to each other, and the workpiece being measured or inspected is carried along the length of the rollers. Since the seating of a stable workpiece in the rollers is extremely accurate, an air gauge or similar close tolerance measuring device may be positioned so that workpieces travelling along the rollers are measured when they pass the gauge. Similarly, the workpiece may be inspected, as by a light sensing photocell, to assure that a particular feature of the workpiece (e.g. the centering of a hole in a circular workpiece) is present. As used in this specification, the term "stable" does not refer to the inherent stability of an object, but rather the ability of that object to stably maintain a desired position when it is supported by the rollers of a classifying machine.

A common problem with classifying machines is their inability to maintain certain shapes of objects in a stable orientation while they are being carried along the rollers. In particular, a workpiece in which one dimension is much smaller than its other dimensions cannot easily be stabilized between the rollers unless the smaller dimension is horizontally oriented. For example, a thin, flat washer can be classified according to its depth but not its diameter, because it will not assume a stable position between the rollers if it is horizontally oriented. The washer will generally tilt and fall between the rollers before reaching a point where the spacing between the rollers equals the washer's diameter, resulting in an inaccurate classification of the washer. The range of uses and versatility of such machines would thus be greatly increased if unstable workpieces could be stably supported on the rollers in a desired position, while travelling on the machine.

OBJECTS OF THE INVENTION

It is a broad object of this invention to provide an improved classifying machine. Specifically, it is an object to provide such a machine which is useful for classifying or measuring or inspecting unstable workpieces.

It is another object of this invention to provide an attachment for existing classifying machines which permits them to be used with unstable workpieces.

These and other objects and features will become apparent from the following description of the preferred embodiments of the present invention.

SUMMARY OF THE INVENTION

According to the invention, a guide member is provided along the length of and between the two rollers of a classifying machine. The guide member is positioned in proximity to one of the rollers and the height of the guide member is fixed according to the shape and size of a workpiece so that the guide member supports one end of the workpiece when that end of the workpiece is in contact with the surface of the roller adjacent the guide member.

When a workpiece is fed onto the rollers, one end of it is guided onto the guide member and buttressed against the surface of the adjacent roller. The other end of the workpiece is guided onto the surface of the other roller so that the workpiece is supported by the two rollers and the guide member in a stable configuration.

BRIEF DESCRIPTION OF THE DRAWINGS

FIG. 1 is a perspective view of a jig incorporating the present invention, mounted on a classifying machine.

FIG. 5 is a sectional view taken along lines 5—5 of FIGS. 1 and 2 with the classifying machine broken away.

DESCRIPTION OF THE PREFERRED EMBODIMENT

Figure 2:
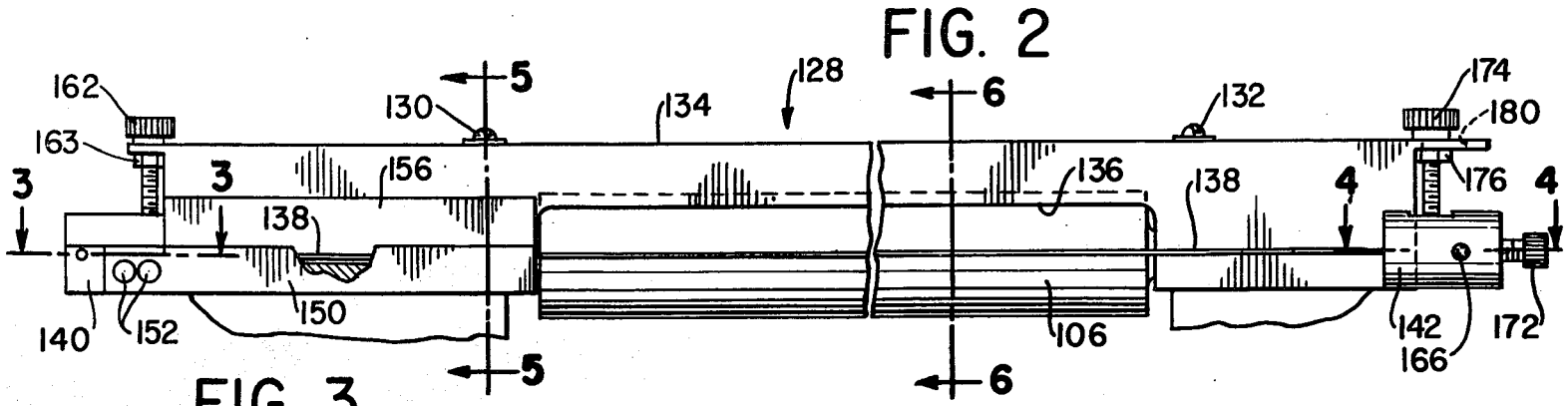
FIG. 2 is a sectional view taken along line 2—2 of FIG. 1 with the classifying machine broken away.

Referring to FIG. 1 of the drawings, a classifying machine 100 is shown having a supporting framework 101 with a feed end 102, a discharge end 104, roller 106 which is fixed in position, and roller 108 which is laterally and obliquely adjustable relative to roller 106. Rollers 106 and 108 preferably have straight, cylindrical rolling surfaces. A handwheel 110 is provided to regulate and adjust the height of the feed end 102, and a handwheel 112 is used to adjust the lateral position of both ends of roller 108 with respect to roller 106 (coarse adjustment). A handwheel 114 is used to make the separate fine adjustment of the roller spacing at the feed end 102 and a similar handwheel 116 is used for the separate fine adjustment at the discharge end 104. The rollers 106 and 108 may thus be adjusted to operate in either parallel or oblique (V-shaped) relation. Classifying chutes or hoppers 118 may also be provided for use with the oblique roller operation, so that, when a workpiece reaches a clearing point, it falls into a corresponding hopper and is classified together with other workpieces which fell from the rollers 106 and 108 at the same clearing point. A motor (not shown) is used to drive belts 122 and 124, which, respectively, rotate rollers 106 and 108 in the directions indicated by the arrows in FIG. 1. This rotation reduces surface friction between the rollers and a workpiece 126, and minimizes wear on the rolling surfaces.

In accordance with the present invention, a guide member 138 is positioned between the rollers of classifying machine 100, running alongside fixed roller 106 so as to provide support for otherwise unstable workpieces. In the preferred embodiment illustrated, this guide member 138 is incorporated in a jig 128 which mounts to classifying machine 100 with screws 130 and 132. As seen in FIGS. 2 through 5, jig 128 comprises a rigid frame 134 constructed of 90° angle iron or other suitable material. Frame 134 is constructed with an opening 136 through which a workpiece 126 may contact the surface of roller 106. Guide member 138 is suspended in front of opening 136 by means of tension blocks 140 and 142, and preferably comprises a suitable filament or wire, e.g., made of hardened steel.

Figure 3:
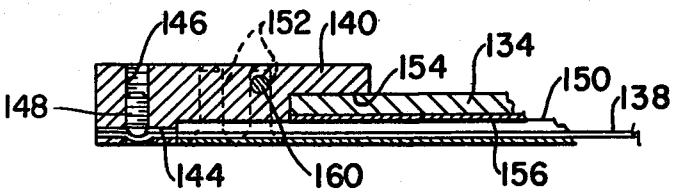
FIG. 3 is a sectional view taken along line 3—3 of FIG. 2.

Tension block 140, which is preferably a machined piece of aluminum, is shown in cross-section in FIG. 3. Intersecting holes 144 and 146 are drilled in block 140, and hole 146 is tapped or threaded to accept set screw 148. After guide member 138 is passed through hole 144, set screw 148 is tightened against the guide member, thereby crimping it slightly into hole 146 and holding it rigidly in place.

Tracking strip 150 is attached to block 140 by recessed screws 152, creating a groove 154 which straddles the left (feed) end of frame 134. Slide plate 156 is attached to the left end of frame 134 by screws 158 (FIG. 5), and fits in groove 154 along with frame 134, as seen in FIG. 3. Thus, the height of the feed end of guide member 138 may be adjusted by sliding tension block 140 up or down along the left end of frame 134 and slide plate 156. Block 140 may also include a tapped hole 160 into which an adjusting screw 162 is threaded for precise adjustment of its height. After the height of block 140 is properly set, nut 163 may be tightened against frame 134 to lock block 140 at the desired setting.

Figure 4:
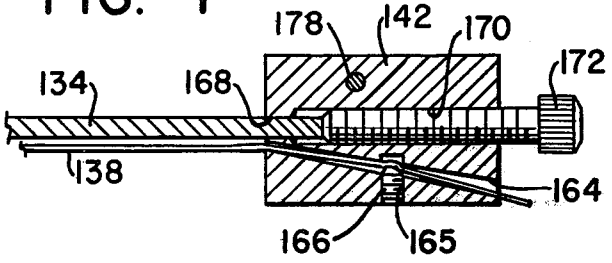
FIG. 4 is a sectional view taken along line 4—4 of FIG. 2.

Tension block 142 holds guide member 138 at the right (discharge) end of frame 134, in a manner similar to that of tension block 140. Intersecting holes 164 and 165 are bored in block 142 as shown in FIG. 4, with hole 165 being tapped to accept a set screw 166. After guide member 138 is passed through hole 164, it is locked in place with set screw 166. Block 142 is positioned on the right end of frame 134 with groove 168 straddling frame 134 as seen in FIG. 4. Tapped hole 170 is bored longitudinally in block 142, opening onto groove 168. Screw 172, threaded in hole 170, pushes against the right end of frame 134, providing adjustable tension for guide member 138. Adjustment screw 174 and lock nut 176 cooperate with tapped hole 178 to adjust the height of block 142. An elongated hole 180 is provided in frame 134 for adjustment screw 174, since the position of this screw changes when tensioning screw 172 is adjusted.

Figure 6:
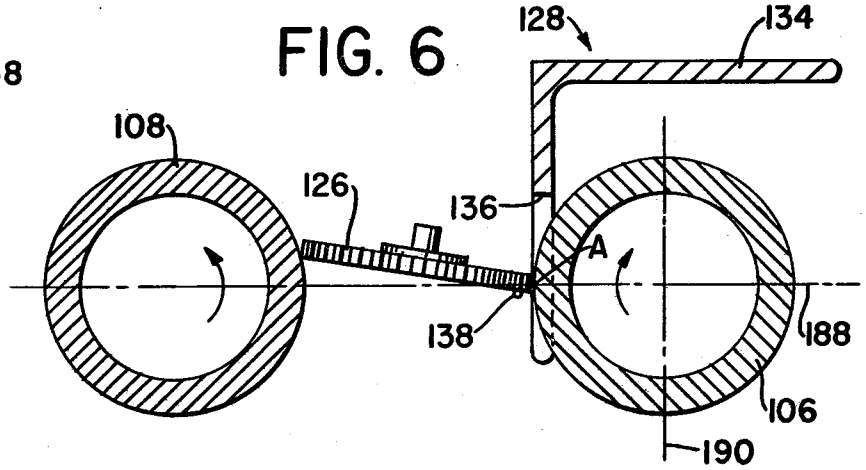
FIG. 6 is a simplified sectional view taken along lines 6—6 of FIGS. 1 and 2.

FIGS. 5 and 6 illustrate the mounting of jig 128 on the classifying machine 100 of FIG. 1. The lateral distance of guide member 138 from the face of roller 106 at the feed end may be adjusted by loosening screw 130 and turning lateral adjustment screw 182, causing the feed end of frame 134 to move laterally with respect to roller drive housing 184. Screw 130 is then tightened to lock frame 134 in place at the desired setting. A similar arrangement is provided at the discharge end of jig 128, using lateral adjustment screw 186. The distance of guide member 138 from the surface of roller 106 may thus be independently adjusted at the feed and discharge ends.

By independently adjusting the height of the feed and discharge ends of guide member 138 with adjustment screws 162 and 174, a user may set both the height and angle of guide member 138 relative to a central plane 188 containing the axes of the two rollers. The independent adjustment of lateral adjustment screws 182 and 186 further permits the user to set the lateral and oblique positions of guide member 138 relative to a vertical plane 190 through the axis of roller 106. These adjustment features provide jig 128 with the ability to accommodate workpieces of varying shapes and sizes as hereinafter described.

In operation, a workpiece 126 is carried to classifying machine 100 by an external feeding apparatus (not shown) such as a conventional vibratory feeder. The workpiece is oriented by the feeding apparatus so as to move onto tracking strip 150, slide plate 156 and auxiliary track 192 in roughly the same position which it is to assume when seated between rollers 106 and 108 (see FIGS. 5 and 6). The spacing between slide plate 156 and lip 194 of tracking strip 150 is designed to support and stabilize workpiece 126, as it is guided toward the rollers, in substantially the same manner as will be provided by guide member 138 and roller 106. As seen in FIGS. 2 and 5, guide member 138 rests in a channel between lip 194 and slide plate 158, so that a workpiece moving along tracking strip 150 may make a smooth transition onto guide member 138 at the end of the tracking strip 150.

After the workpiece 126 has been transferred onto rollers 106 and 108, it is maintained in stable contact with the rollers' surfaces by guide member 138 which functions in the manner described below.

Figure 7:
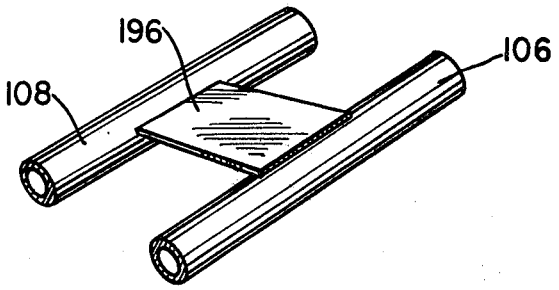
FIG. 7 illustrates a flat, rectangular plate supported by a pair of rollers.
Figure 8:
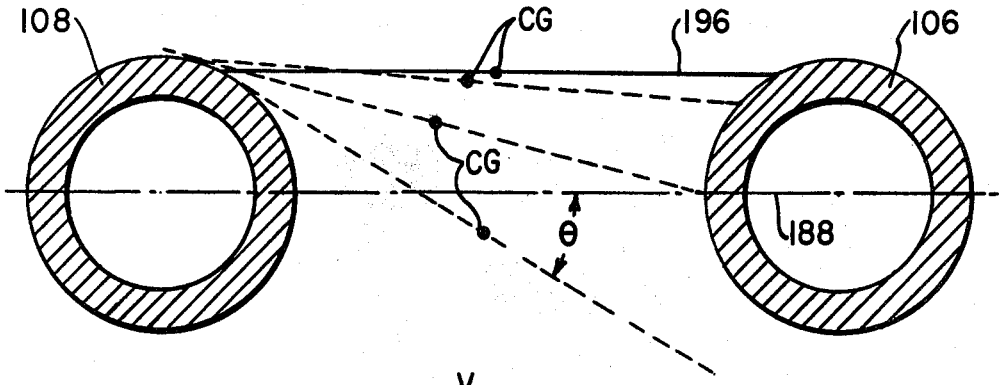
FIG. 8 is a cross-sectional view of the flat plate and rollers of FIG. 7, illustrating the movement of the plate on the rollers as it shifts from a horizontal position.

FIGS. 7 and 8 help to illustrate the movement of a workpiece on a classifying machine. In FIG. 7, a flat plate 196 (workpiece) is balanced on a pair of parallel rollers. In the absence of friction, a plate which is not horizontally positioned will tilt and fall between the rollers, following a path of motion as shown in FIG. 8. For all practical purposes, the rotation of the rollers essentially eliminates the surface friction of most workpieces; thus, the absence of friction will be assumed in the following discussion unless otherwise stated.

The seating of a workpiece between the rollers varies according to its shape and center of gravity. Disregarding movement along the length of the rollers, as the position of a workpiece is shifted while it rests against the rollers, the vertical movement of its center of gravity determines whether it is stable, unstable or neutrally stable in a given position. FIG. 8 illustrates this concept with regard to the flat plate 196 of FIG. 7, showing the movement of its center of gravity (CG) as it shifts from a horizontal orientation to the point where it loses the support of the right roller. As the plate 196 shifts, its CG moves steadily downward, thus indicating that the workpiece was unstably seated in the horizontal position.

Expressing the relative vertical position of the plate's CG as its potential energy V (where V = object's weight times height of the object's CG above a fixed reference level) the stability characteristic of the plate 196 can be determined by referring to a graph of V with respect to $\theta$, the angle of the plate 196 relative to the horizon as the plate shifts position on the rollers. In such a graph, the workpiece in question may only reach equilibrium at a position where the slope of the graph equals zero. If this point is a maximum value for $V(\theta)$ relative to its surrounding points, then the equilibrium is unstable; if it is a minimum, the equilibrium is stable.

Figure 9:
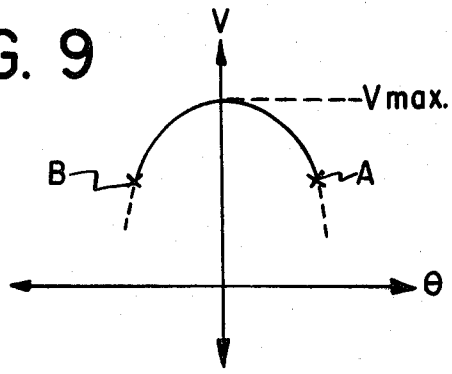
FIG. 9 is a graphical representation of the movement of the plate in FIG. 8.

FIG. 9 illustrates this graph for the plate 196 of FIG. 8. It will be seen that the curve has only one point where its slope equals zero, that point occurring when the plate 196 is horizontal, or $\theta=0$. Since this point is a maximum value for $V(\theta)$ relative to its surrounding points, this indicates a position of unstable equilibrium. Furthermore, since the right or left side of the plate 196 loses its respective roller's support at points A or B on the graph, it is apparent that there is no position in which the plate will attain stable equilibrium while in contact with both rollers, since there are no points on the graph from A to B where the value of $V(\theta)$ is a minimum relative to the surrounding points on the graph.

Figure 10:
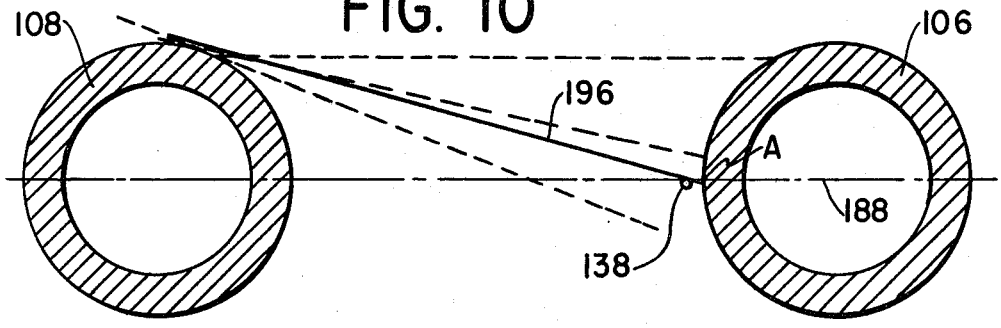
FIG. 10 illustrates the plate of FIGS. 7 to 9, seated on the rollers and supported by a guide member.
Figure 11:
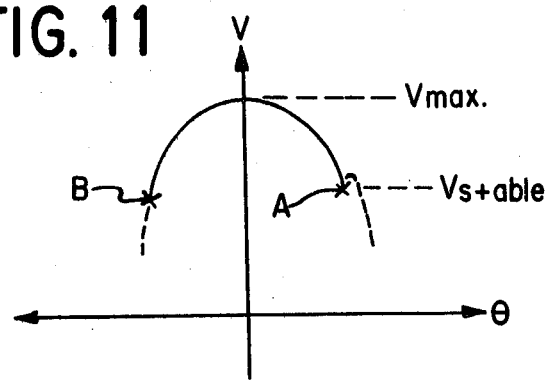
FIG. 11 is a graphical representation of the movement of the plate in FIG. 10.
Figure 12:
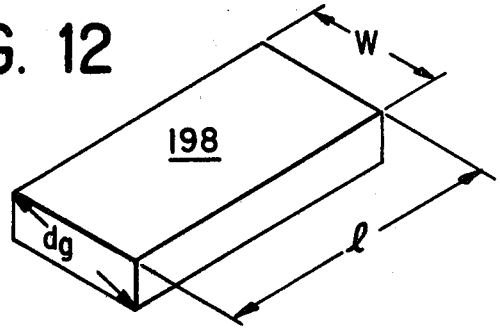
FIG. 12 illustrates a rectangular block which may be used as a work piece.

The present invention operates by providing a guide member positioned so as to alter the V vs. $\theta$ graph of a given workpiece, creating a relative minimum value of the graph when the workpiece is in a desired orientation in contact with both rollers of a classifying machine. FIG. 10 shows the effect of such a guide member 138 on the path of the plate 196 of FIG. 8, and FIG. 11 is a graph of V vs. $\theta$ for the plate 196 in FIG. 10. It will be seen that guide member 138 alters the path of the workpiece 196 seen in FIG. 8 so that, in order for the workpiece to continue falling past point A on FIG. 9, it must first move up and to the left, clearing guide member 138. This creates a sharp upward shift in the curve of FIG. 11 at point A, thereby producing the necessary minimum value of the curve needed for stable equilibrium at a point where the plate 196 is in contact with both rollers.

With a workpiece stably seated, its classification or measurement may be done with extreme accuracy, limited only by the tolerances of the rollers and the guide member. The effect of inconsistencies in the surface of the guide member may be minimized by positioning it for a specific task so as to take advantage of the close tolerances of the rollers' surfaces.

For example, in a classification operation, the error induced by an imperfect guide member will generally be minimized if the end of the workpiece resting on the guide member contacts the roller which is adjacent the guide member (defined as the adjacent roller) at the point where that roller's surface intersects the central plane. This case may be illustrated with reference to FIG. 10, where the contact point is denoted A, and the central plane is 188. If the surface of the guide member 138 (the guide surface) has an imperfection which causes the contact point (A) to shift slightly up or down with respect to the central plane 188, the horizontal change in position of plate 196 (as seen from the viewpoint of FIG. 10) will be negligible compared to the vertical change caused by the imperfection. However, if the contact point were not on or near the central plane 188, more horizontal movement would be induced by imperfections in the guide surface, since the slope of the roller's face has a horizontal component which increases with distance from the central plane. Since the horizontal separation of the rollers determines when a workpiece will fall into its respective classifying chute, horizontal movement of the workpiece should be avoided. Thus, a contact point near the central plane usually results in the most accurate method of classification, as it minimizes such horizontal workpiece movement induced by imperfections in the surface of a guide member. Nevertheless, it is important for the guide surface to be accurate, as any inconsistency therein will affect the overall accuracy of the system.

While it is often desirable to position the inventive guide member so that workpieces seated on the rollers contact the adjacent roller at or near the central plane, the requirements of a given task may call for a different contact point to be used. In such a case, the guide member may be positioned so as to establish the desired contact point between a given workpiece and the adjacent roller. As long as the positioning of the guide member creates the desired minimum value in the workpiece's CG (as discussed above) when the workpiece is touching the desired contact point, the workpiece will be stably seated on the rollers. It should be noted that the clearing point of a workpiece during a classifying operation will vary depending on the location of the contact point of a workpiece being classified. The workpiece will clear the non-adjacent roller at the point where the distance between the contact point and the surface of the non-adjacent roller is shortest; for example, a contact point located at the central plane will result in a clearing point where the central plane intersects the surface of the non-adjacent roller. However, the invention should not be considered as limited to this case, since the selection of a different set of contact and clearing points for a given workpiece may be preferable for a particular classifying operation.

Figure 13:
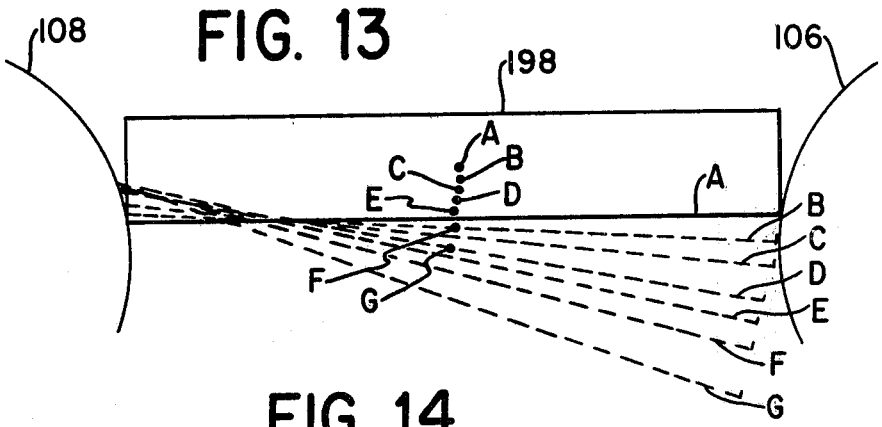
FIG. 13 shows the block of FIG. 12 balanced lengthwise between a pair of rollers in a horizontal position, and the movement of the block as it shifts from the horizontal.

In contrast to the flat plate of FIGS. 7–11, FIG. 12 shows a rectangular block 198 having a length (L) substantially greater than its width (W). As seen in FIG. 13, this block 198 demonstrates a similar stability characteristic to that of the flat plate 196 in FIGS. 8 and 9 when the block is fed lengthwise across the rollers. The CG of block 198 continuously drops as the block tilts away from a horizontal position, eventually losing support and falling away from the rollers. However, the block 198 displays a different stability characteristic when oriented widthwise across the rollers.

Figure 14:
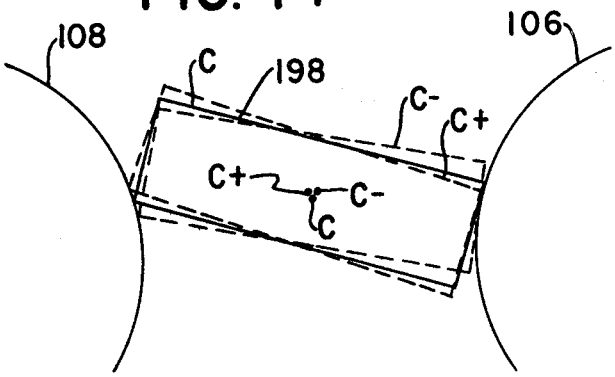
FIG. 14 shows the block of FIG. 12 seated widthwise between a pair of rollers in a stable configuration, and the movement of the block as it is shifted about the stable position.
Figure 15:
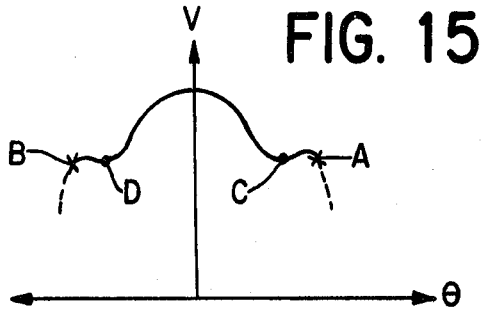
FIG. 15 is a graphical representation of the movement of the block in FIG. 14.

FIG. 14 shows block 198 seated widthwise on a pair of rollers in stable equilibrium (position C), and the change in its CG when the block is moved to either side of the equilibrium position (positions C+ and C−). FIG. 15 shows a graph of V vs. $\theta$ for block 198, in which points A and B are the extremes of $\theta$ where the block loses support from the right and left rollers respectively. Points C and D are the two minima of the graph, or the points where block 198 attains stable equilibrium while in contact with the rollers.

Figure 16:
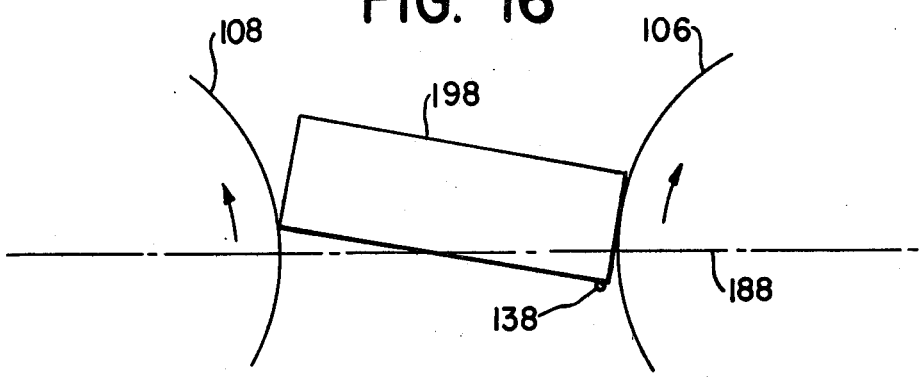
FIG. 16 shows the block of FIG. 14 further supported by a guide member.
Figure 17:
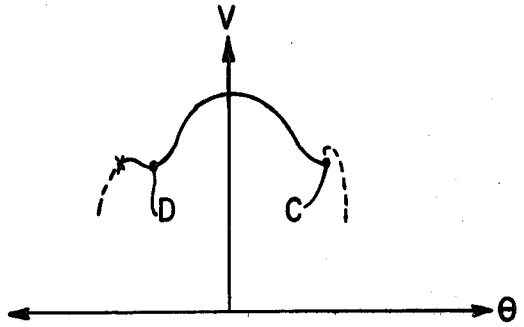
FIG. 17 is a graphical representation of the movement of the block in FIG. 16.

Although it appears that there is no need to use a guide member for stabilizing the block 198 shown in FIG. 14, several situations may occur wherein the use of the inventive guide member is advantageous in spite of the stability of such a workpiece. The depth and sharpness of a workpiece's V vs. $\theta$ curve in the vicinity of a minimum point affects the way the workpiece responds to destabilizing forces. Examples of such forces are frictional forces between the workpiece and the rollers or guide member (which were assumed to be negligible in the above discussion), disruptive forces caused by imperfections in the rollers or guide surfaces, and destabilizing forces resulting from vibration, air currents and the like. In the case of the block 198 of FIG. 14, whose stability characteristic is shown in FIG. 15, one or more of the above forces may cause the block to rotate clockwise. This motion may cause the corresponding point on the graph to move away from minimum point C, following the relatively shallow slope of the graph past point E, at which point block 198 will continue to rotate clockwise and fall from the rollers. Thus, in order to assure stability in situations where a workpiece's stability characteristic contains poorly defined minima, it may be advantageous to use a guide member 138 for deepening a minimum point on the workpiece's stability characteristic, as shown in FIGS. 16 and 17, with regard to the block 198 of FIGS. 14 and 15.

Another situation in which a guide member may be used with an otherwise stable workpiece occurs when the desired position of the workpiece on the rollers is different from the workpiece's stable position(s). For example, it may be desirable to classify block 198 of FIG. 12 according to its diagonal dimension DG. Although the block's stability characteristic would not ordinarily permit such classification, a guide member 138 may be used as in FIG. 18 to maintain the lower right-hand corner of block 198 in contact with the surface of the right-hand roller, at or near the level of the central plane 188 as shown. As block 198 moves forward along the rollers, and the rollers begin to separate, the block will rotate counterclockwise and fall from the rollers when their separation is greater than the diagonal dimension of the block. While this illustration has been made with regard to a classifying operation, it will be equally apparent that the ability of the inventive guide member to stabilize a workpiece in a range of different positions would enhance the use of a classifying machine as a traveling "V block," in which a workpiece would assume and maintain a predetermined position with extreme accuracy as it travels along the rollers.

Figure 18:
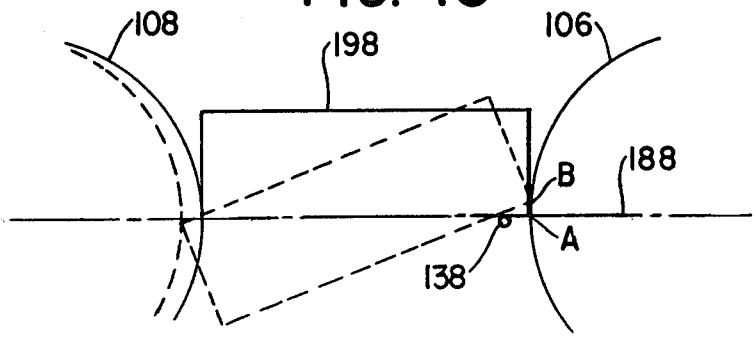
FIG. 18 shows the block of FIG. 12 seated widthwise between a pair of rollers and supported by a guide member, and the movement of the block as the separation between the rollers increases.

The dotted lines in FIG. 18 indicate the shifting position of block 198 about guide member 138 as the separation between the rollers increases, in the case of a classification operation (where the rollers are obliquely spaced). In such an operation, the most accurate results are usually achieved by maintaining a specific portion of a workpiece to be classified in contact with a specific point about the periphery of the roller adjacent the guide member (the adjacent roller), such as the point where that roller's surface intersects the central plane (see point A as in FIG. 18). It may thus be desirable to set the guide member so that, as a workpiece moves forward along the rollers, the position of the guide member relative to the adjacent roller changes to compensate for the workpiece's tendency to move away from the desired point of contact (See point B in FIG. 18). This may be accomplished by adjusting the setting of the guide member in a non-parallel relation to the axis of the adjacent roller, according to the size and shape of the workpiece to be used. In the preferred embodiment described above, this adjustment may be made by independently setting adjusting screws 162, 174, 182 and 186 to achieve the desired non-parallel positioning of wire 138. Such an adjustment would also be useful in a traveling "V block" application, if it were desired to make a workpiece move through a range of positions as it travels along the rollers.

Frequently it is desirable to maintain a circular workpiece in a stable position with its diameter bridging the rollers, while rotating the workpiece to assure constant diameter. In this case, the inventive guide member may serve an additional function by providing a slight drag on the workpiece near its periphery, thereby inducing a rotational force while maintaining the workpiece in stable contact with the rollers. For example, the gear 126 of FIGS. 1, 5 and 6 is shown positioned on the rollers of a classifying machine, which have been set in parallel with the spacing between them slightly less than the diameter of gear 126. Guide member 138 has been positioned to support the one side of gear 126 in contact with roller 106 at point A on central plane 188 (See FIG. 6), while the other side of the gear rests on roller 108 above the central plane. The drag provided by guide member 138 opposes the gear's forward motion along the rollers, causing it to rotate in the direction shown in FIG. 1 as it moves forward. If the gear is missing a tooth, this will be detected as a reduction in diameter, causing it to lose the support of roller 108 and fall away from the rollers as a reject.

While the drag created by the inventive guide member can be used to advantage (as in the preceeding paragraph), a given application may dictate the enhancement or offsetting of this drag in order to achieve a desired effect. One way of doing this is to independently adjust the rotational speeds of the two rollers. By increasing the rotational speed of one roller while maintaining the rotational speed of the second roller constant, the friction between a workpiece and the first roller is reduced. The drag of the guide member is thus either enhanced or offset, depending on which roller's speed is varied. For example, the preceeding paragraph describes the rotational movement of a circular workpiece such as gear 126 in FIGS. 1, 5 and 6, in the case where a guide member is used to stabilize the gear and both rollers are rotating at the same speed. However, if it were desired to make gear 126 rotate more or less often per linear unit of travel along the rollers, the rotational speed of roller 108 could be increased, thus reducing the friction between roller 108 and gear 126 and effectively enhancing the drag of guide member 138. Similarly, the rotation of gear 126 could be reduced (or stopped, if desired) by decreasing the rotational speed of roller 108. As another example of this effect, consider the movement of block 198 along the rollers in FIG. 18, while supported by guide member 138. In this case, the drag of guide member 138 could cause block 198 to yaw with respect to the rollers, resulting in an inaccurate classification of the block. By decreasing the rotational speed of the lefthand roller in FIG. 18 (or, conversely, increasing the rotational speed of the righthand roller), this yawing action can be corrected, permitting the block 198 to track along the rollers in a substantially parallel relation to the rollers, for maximum classification accuracy.

The guide member 138 described above is shown attached to a rigid frame 134, which is detachably mounted on a classifying machine. While this arrangement provides a convenient means for properly positioning a guide member for use as disclosed, there are many ways of positioning such a guide member without the use of a separate framework. For example, a guide member according to the invention may be mounted on the framework of the classifying machine itself. If desired, such a machine could incorporate means for adjusting the points to which a guide member is to be attached, so the position of the guide member could be adjusted to accommodate various applications.

Furthermore, the guide member may be incorporated into an assembly which feeds workpieces onto and away from a classifying machine. In this application, the feeder assembly would include two or more tracks, which carry a workpiece from an external location to the rollers of a classifying machine and align the workpiece for contact with the rollers. One of the tracks would then continue along one of the rollers, supporting one end of the workpiece in contact with that roller's face, according to the invention. The other track or tracks would terminate at the feed end of the other roller, and begin again at the discharge end, carrying away pieces (which did not fall between the rollers) to another location.

The guide member disclosed comprises a tensioned filament, specifically a hardened steel wire, to support and stabilize workpieces in a desired alignment with the surfaces of the rollers. While the use of a tensioned filament is believed to be a novel aspect of this invention, this is not the only form in which the invention may be practiced. For example, a rigid strip of metal, Teflon or other suitable material may be shaped as desired and fastened to the framework of a classifying machine alongside one of the rollers, with the edge of the strip providing support to workpieces according to the invention. There may be applications in which a curved or irregularly shaped guide member may be advantageous, in which case the tensioned filament disclosed may not be adaptable to the desired application. However, for most purposes, a tensioned filament of hardened steel is believed to provide the most advantageous form of guide member, as it provides a highly accurate, inexpensive and wear resistant surface which is easily adapted to suit a given task.

In the embodiment disclosed, adjustment screws 162, 174, 182 and 186 permit the guide member 138 to assume a wide range of positions relative to roller 106, thereby expanding the number of applications in which jig 128 may be useful. However, classifying machines are often used for a single application, as part of a mass production process. In such an application, a simple guide member may be fixedly positioned, thereby eliminating the expense and complexity of adjusting means.

Classifying machines presently in operation comprise rollers which are rotated outwardly, in the direction shown by the arrows in FIG. 6. One of the reasons for this outward rotation is to prevent the friction caused by an inwardly rotating roller from destabilizing an otherwise stably seated object and causing it to fall between the rollers. However, the guide member disclosed may provide sufficient stability to a workpiece to permit alternate combinations of roller rotation, in order to achieve a desired effect. For example, it may be advantageous for the roller nearest to the guide member to rotate inwardly, in order to bias the workpiece toward the surface of the guide member and further assure a stable positioning of the workpiece.

What is claimed is:

1. An improved classifying machine having first and second rollers supported with their rolling surfaces facing and spaced apart from each other, said rollers having respective axes of rotation lying in the same plane, said apparatus including means for rotating said rollers about their axes as a workpiece is fed along at least a portion of the rollers' length while the workpiece is seated between and in contact with the roller' surfaces, the improvement comprising:

an elongated guide member including a tensioned filament disposed between said rollers and extending along a substantial part of the length of said rollers, and means positioning said filament at a position where it provides vertical support to the workpiece while the workpiece is seated in contact with the surfaces of both rollers, and positioning said filament relative to said rollers so that when said workpiece is seated in contact with said rollers and said filament, the center of gravity of the workpiece must rise in order for the workpiece to break contact with either of the roller surfaces.

2. The improvement according to claim 1, further comprising means for adjusting the position of said filament relative to said rollers.

3. An improved classifying machine having first and second rollers supported with their rolling surfaces facing and spaced apart from each other, said rollers having respective axes of rotation lying in the same plane, said apparatus including means for rotating said rollers about their axes as a workpiece is fed along at least a portion of the rollers' length while the workpiece is seated between and in contact with the rollers' surfaces, the improvement comprising:

an elongated guide member disposed between said rollers and having a guide surface extending along a substantial part of the length of said rollers, means positioning said guide member at a position where it provides vertical support to the workpiece while the workpiece is seated in contact with the surfaces of both rollers, and positioning said guide member relative to said rollers so that, when said workpiece is seated in contact with said rollers and said guide member, the center of gravity of the workpiece must rise in order for the workpiece to break contact with either of the roller surfaces, and means for adjusting the lateral distance and height of said guide member relative to at least one of said rollers.

4. The improvement according to claim 3, wherein said adjusting means further adjusts the oblique positioning of said guide member relative to the axis of said at least one roller.

5. The improvement according to claim 4, wherein said rollers are positioned in a supporting framework, and further comprising:

a jig frame having means for detachably mounting said jig frame to said supporting framework, and;

wherein said guide member and said adjusting means are mounted on said jig frame.

6. The improvement according to claim 5, wherein said guide member comprises a tensioned filament.

7. An improved classifying machine as in claim 3, wherein said rolling surfaces of said first and second rollers are straight.

8. An improved classifying machine as in claim 7, wherein said rolling surfaces are cylindrical.

9. An improved classifying machine as in either of claims 1 or 3, wherein said positioning means further positions said guide member so as to permit said workpiece to pivot about said guide member and fall through said rollers if and when a clearing point is reached where a selected dimension of said workpiece is less than the spacing between said rollers.

10. A classifying machine comprising:

first and second rollers each having a rolling surface and an axis of rotation;

means for supporting said rollers with their rolling surfaces facing and spaced apart from each other and with their respective axes of rotation lying in the same plane;

means for rotating said rollers about their respective axes;

an elongated guide member including a tensioned filament disposed between said rollers and extending along a substantial part of the length of said rollers; and means for positioning said filament at a position where it provides vertical support to a workpiece while the workpiece is seated in contact with the surfaces of both rollers, and for positioning said filament relative to said rollers so that when said workpiece is seated in contact with said rollers and said filament, the center of gravity of the workpiece must rise in order for the workpiece to break contact with either of the roller surfaces.

11. A classifying machine as in claim 10, further comprising means for adjusting the position of said filament relative to said rollers.

12. A classifying machine comprising:

first and second rollers each having a rolling surface and an axis of rotation;

means for supporting said rollers with their rolling surfaces facing and spaced apart from each other and with their respective axes of rotation lying in the same plane;

means for rotating said rollers about their respective axes;

an elongated guide member disposed between said rollers and having a guide surface extending along a substantial part of the length of said rollers;

means for positioning said guide member at a position where it provides vertical support to a workpiece while the workpiece is seated in contact with the surfaces of both rollers, and for positioning said guide member relative to said rollers so that when said workpiece is seated in contact with said rollers and said guide member, the center of gravity of the workpiece must rise in order for the workpiece to break contact with either of the roller surfaces; and means for adjusting the lateral distance and height of said guide member relative to at least one of said rollers.

13. A classifying machine as in claim 12, wherein said adjusting means further adjusts the oblique positioning of said guide member relative to the axis of said at least one roller.

14. A classifying machine as in claim 13, wherein said rollers are positioned in a supporting framework, and further comprising:

a jig frame having means for detachably mounting said jig frame to said supporting framework, and;

wherein said guide member and said adjusting means are mounted on said jig frame.

15. A classifying machine as in claim 14, wherein said guide member comprises a tensioned filament.

16. A classifying machine as in either of claims 10, 15 or 12, wherein said positioning means further positions said guide member so as to permit said workpiece to pivot about said guide member and fall through said rollers if and when a clearing point is reached where a selected dimension of said workpiece is less than the spacing between said rollers.

17. An improved classifying machine as in claim 12, wherein said rolling surfaces or said first and second rollers are straight.

18. An improved classifying machine as in claim 17, wherein said rolling surfaces are cylindrical.

19. A classifying machine as in either of claims 10 or 12, wherein said means for rotating said rollers further comprises means for independently varying the respective rotational speeds of each of said rollers.

20. A jig for use with a classifying machine having first and second rollers supported with their rolling surfaces facing and spaced apart from each other, said jig comprising:

a jig frame having means for detachably mounting said jig frame to said classifying machine;

a tensioned filament mounted on said jig frame; and means mounted on said jig frame for positioning said filament at a position where it provides vertical support to a workpiece while the workpiece is seated in contact with the surfaces of the rollers of the classifying machine, and for positioning said filament relative to said rollers so that when said workpiece is seated in contact with said rollers and said filament, the center of gravity of the workpiece must rise in order for the workpiece to break contact with either of the roller surfaces.

21. A jig as in claim 20 further comprising means mounted on said jig frame for adjusting the position of said filament relative to said rollers.

22. A jig as in claim 21, wherein said adjusting means operates to adjust the lateral distance and height of said filament relative to at least one of said rollers.

23. A jig as in claim 22, wherein said adjusting means further adjusts the oblique positioning of said filament relative to the axis of said at least one roller.

24. A jig as in either of claims 20 or 22, wherein said positioning means further positions said filament so as to permit said workpiece to pivot about said filament and fall through said rollers if and when a clearing point is reached where a selected dimension of said workpiece is less than the spacing between said rollers.

* * * * *